US007293773B2

(12) United States Patent
Bradley

(10) Patent No.: US 7,293,773 B2
(45) Date of Patent: Nov. 13, 2007

(54) CARD GAME

(76) Inventor: Bruce Bradley, P.O. Box 46, Yarraville, Victoria (AU) 3013

( * ) Notice: Subject to any disclaimer, the term of this patent is extended or adjusted under 35 U.S.C. 154(b) by 98 days.

(21) Appl. No.: 11/307,811

(22) Filed: Feb. 23, 2006

(65) Prior Publication Data

US 2006/0125179 A1 Jun. 15, 2006

Related U.S. Application Data

(62) Division of application No. 10/490,694, filed on Mar. 24, 2004, now abandoned.

(51) Int. Cl.
*A63F 1/00* (2006.01)

(52) U.S. Cl. ..... 273/299; 273/302; 273/303; 273/308; D21/376; D21/381; 434/172

(58) Field of Classification Search ..... 273/299–308, 273/292, 293, 294; 434/172; D21/376, D21/381
See application file for complete search history.

(56) References Cited

U.S. PATENT DOCUMENTS

| | | | | |
|---|---|---|---|---|
| 142,075 | A | 8/1873 | Billings | |
| 506,848 | A | 10/1893 | McGeorge | |
| 958,258 | A | 5/1910 | Leach | |
| 1,716,069 | A | 6/1929 | Loayza | |
| 1,791,708 | A | 2/1931 | Bridges | |
| 1,890,504 | A | 12/1932 | Ferguson, Jr. | |
| 2,034,991 | A | 3/1936 | Salinger | |
| 2,099,611 | A | 11/1937 | Levoy | |
| 2,383,081 | A | 8/1945 | Ribbe | |
| 3,333,351 | A | 8/1967 | Williams | |
| 3,547,444 | A | 12/1970 | Williams et al. | |
| 3,817,533 | A | 6/1974 | Leidenfrost | |
| 4,014,551 | A | 3/1977 | Alfonso | |
| 4,050,698 | A * | 9/1977 | Brown | 273/292 |
| 4,508,513 | A | 4/1985 | Donovan | |
| 4,779,870 | A | 10/1988 | Nichols | |
| 4,944,519 | A | 7/1990 | Canela | |
| 5,205,563 | A | 4/1993 | Dearing | |
| 5,390,935 | A | 2/1995 | Wilkins | |

(Continued)

FOREIGN PATENT DOCUMENTS

FR 2530479 A 1/1984

(Continued)

*Primary Examiner*—Benjamin Layno
(74) *Attorney, Agent, or Firm*—David A. Guerra

(57) ABSTRACT

A method of playing a card game and a pack of cards for use therewith, the pack including a number of topic cards at least one of which is selected by the player and a number of playing cards in a pack which can be shuffled, a first additional card being located beneath the topic card and, if this additional card does not incorporate an "END" on its lower edge, a further additional card is located therebeneath until the lower end of an additional card incorporates the word "END", the lower portion of each card, unless it is a card with an "END", having the first part of a sentence and the upper portion of each card, unless it is a topic card, having the completion of a sentence, the player then reading the sentence(s) on the cards dealt. The cards can be in the form of a tarot pack for persons who are interested in this art, but this is not necessary.

17 Claims, 3 Drawing Sheets

U.S. PATENT DOCUMENTS

| | | | |
|---|---|---|---|
| 5,401,032 | A | 3/1995 | Barnhart et al. |
| 5,435,726 | A | 7/1995 | Taylor |
| 5,599,020 | A | 2/1997 | Fields |
| 5,662,332 | A | 9/1997 | Garfield |
| 5,954,331 | A | 9/1999 | Hepburn |
| 2004/0108657 | A1 | 6/2004 | Onstad et al. |

FOREIGN PATENT DOCUMENTS

| | | | | |
|---|---|---|---|---|
| GB | 2091112 | A | * | 7/1982 |
| GB | 2160111 | A | | 12/1985 |

* cited by examiner

CARD GAME

CROSS-REFERENCE TO RELATED APPLICATIONS

This application is a divisional application under 35 U.S.C. §121 and 37 CFR 1.53(b) based upon co-pending U.S. application Ser. No. 10/490,694 filed Mar. 24, 2004. Additionally, this divisional application claims the benefit of priority of co-pending U.S. application Ser. No. 10/490,694 filed Mar. 24, 2004 and International Application No. PCT/AU02/01304 filed Sep. 23, 2002. The entire disclosures of the prior applications are incorporated herein by reference.

FIELD OF THE INVENTION

This invention relates to an improved game and in particular to a game which can enable readers to generate for a player a story based on a particular aspect of life.

DESCRIPTION OF RELATED ART

Over the years there have been many systems which purport, either seriously or for amusement, to read the future.

Possibly the longest extending one of these is Tarot which initially came into existence in the mid-1300's and the form of Tarot which is not substantially different from that used today as long ago as the mid-1400's.

Tarot cards are basically pictorial and the reader lays a number of the cards out in a spread and, from knowledge, intuition and reaction, to use these cards to define aspects of life and the future of the subject.

Much Tarot is done very seriously and there are many believers in this, and much is done as an amusement.

A normal Tarot pack has 78 picture cards and historically these had no words but subsequently individual words could be placed on the cards to give an indication to non-skill of the subject matter of the cards.

The original card was developed when literacy was fairly low and it was expected there would be an intuitive understanding of what was meant by the card. Each of the cards could be considered to have two meanings, the second being when the card is reversed and very often the second meaning was a negation of the first meaning.

When Tarot is being used, a number of the cards are placed in a spread and the reader uses these cards to provide a reading relating to the particular person for whom the cards have been laid down.

It will be appreciated there are many combinations of card and the meaning which can be attributed to any particular combination will depend, to an extent, on the skill of the reader, reaction of the subject and the desirability to maintain interest.

A skilled Tarot reader can provide very convincing results and many persons whose cards are read, firmly believe that they do provide an indication of that person's future, at least in some aspects of life.

The results from Tarot are largely dependent upon the skill of the person reading the cards but it has a very wide worldwide reputation in use.

There have also been a substantial number of card games which, with more or less seriousness, intend to provide amusement and information to players and, for example, some of these are illustrated in: U.S. Pat. Nos. 2,034,991; 5,954,331; 5,599,020; 142,075; 2,383,081; 4,014,551; 1,716,069; and 5,435,726.

The games illustrated in the various US patents cited above tend to be self descriptive and would need little skill but, at the same time, are somewhat trivial.

BRIEF SUMMARY OF THE INVENTION

The object of the present invention is to provide an amusement card game which can, if required, take a general Tarot format and, in which, the players of the game, by distribution of the cards, can establish a meaning from the cards which can vary from time to time when the game is played, and from player to player.

The invention includes a game having a number of sources of information in which two pieces of information each from a separate source are brought into juxtaposition by locating the sources together and are adapted, when so brought, to be read sequentially and to provide a player with information as part of the output of the game.

In this specification, we will refer to a player, the person to which the information is directed and a reader, the person who places the information and who interprets the information for the player. The game may, however, be played by a single person who first sets up the information and then interprets the information for her or him self.

In a first form of the game each source is a card and a first part of the information is adjacent the bottom of a first card and a second part of the information is adjacent the top of a second card so that when the top of the second card is brought into contact with the bottom of the first card the two pieces of information are able to be read.

The cards may be physical cards or they could be representations of cards or other representations on a video screen, such as a computer screen.

In a particular aspect, the game is a card game which includes a number of Subject cards at least one of which is selected by the player and a number of game cards in a pack which can be shuffled, a first additional card being located beneath the subject card and, if this additional card does not incorporate an "END" on its lower edge, a further additional card is located therebeneath until the lower end of an additional card incorporates the word "END", the lower portion of each card, unless it is a card with an "END", having the first part of a sentence and the upper portion of each card, unless it is a subject card, having the completion of a sentence, the reader then reading the sentence(s) on the cards dealt.

The additional cards may also have side positions and, where there is an indication of a side position, then a card can be connected thereto.

Each of the additional cards may have the same format but different material on both its front and its back and when the game is being played, the cards may not only be shuffled, to obtain a random arrangement of cards, but they can also be turned over so that the mixture of the two sides of the cards is modified.

The invention also includes a pack of cards adapted to enable the card game to be played.

BRIEF DESCRIPTION OF THE DRAWINGS

In order that the invention may be more readily understood we shall refer to the accompanying drawings, which illustrate exemplary cards in which.

DETAILED DESCRIPTION OF THE INVENTION

Figure 1:
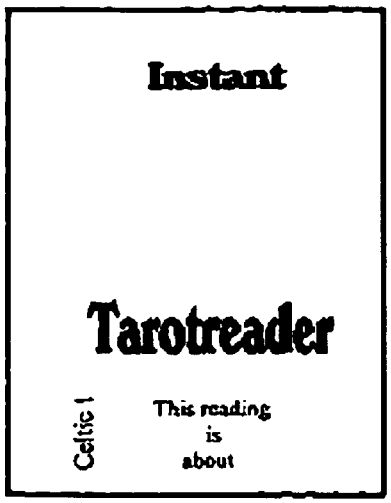
FIG. 1 shows a Subject card.

For purposes of exemplification we will consider the use of a pack which is basically constituted in the same manner as a Tarot pack so that persons who are skilled Tarot readers can associate some of their prior knowledge in interpreting the results of a game.

It is stressed that, for the game to be played, there is no necessity whatsoever for the reader or the player to have any Tarot knowledge and indeed similar games can be played using cards which have no relationship to Tarot cards.

Secondly, this is a game and does not pretend to give any person an accurate indication of past, present or future life events.

Having said that, it is possible that individuals may get certain reinforcement in areas in which they are already committed or intend to be committed and, as such, can see the game as something of importance.

It is also stated that the material various persons obtain from the game may well be somewhat convoluted or ambiguous and in order to satisfactorily obtain greatest amusement from the game, the person "reading" the card may have to use a degree of imagination to obtain anything meaningful from them.

In order to show the comparison with Tarot, a Tarot pack includes 78 playing cards, called Story cards, which incorporate the major arcana of which there are 22 and the minor arcana of which there are 56. We can provide a pack which has 78 double sided Story cards which is comprised of 22 major arcana cards and 56 minor arcana Story cards.

The minor arcana Story cards are split into four suits and we show these suits by a marking on the card, a green square representing earth, a red up-right triangle representing fire, a blue inverted triangle representing water and a yellow oval representing air.

Also each suit has fourteen cards: four Court cards, a King, a Queen, a Knight and a Page and ten other cards from ace to ten. The suits are called by common element names, Earth, Fire, Water and Air. Each are, on the cards, represented by a symbol. Earth is a green square; Fire is a red upright triangle, Water an inverted blue triangle and Air as a yellow circle.

We have also shown my view of the elemental form of The Major Arcana Story cards, that being radiation which we have indicated here as a purple diamond.

We also prefer to have a message on each side of the Story cards so; in fact, there are 156 faces which incorporate material.

As mentioned before, the fact that the cards are set up as a Tarot pack is not limiting but we do endeavor, where Tarot type cards are used, to have the material on the cards appropriate for the particular card.

Major arcana cards represent the element radiation and by a marking on the card of a purple diamond. These major arcana cards can have a drawing or picture together with some written material indicating what concept the card represents.

Referring to the Figures, and the actual cards used could be more decorative, and the Figures simply include the material for the game.

FIG. 1 shows a Subject card. This is a Celtic Subject card, one of a set of 11, but there can be other sets.

The Subject cards originate the commencement of the story line. They can, together with the Story cards be double-sided.

Figure 2:
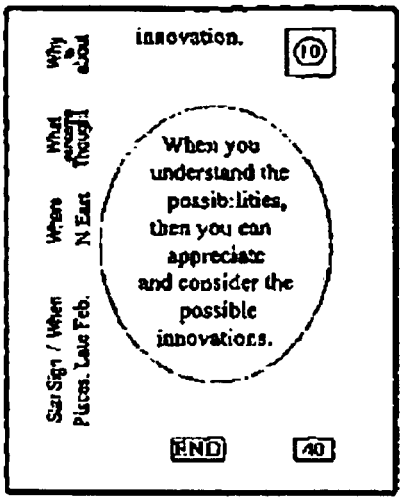
FIG. 2 shows an 'END' card.
Figure 3:
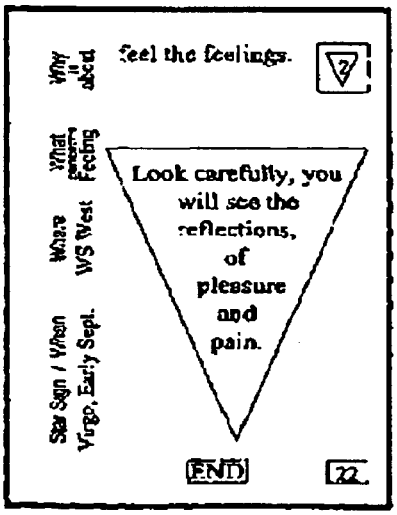
FIG. 3 shows a further 'END' card.
Figure 4:
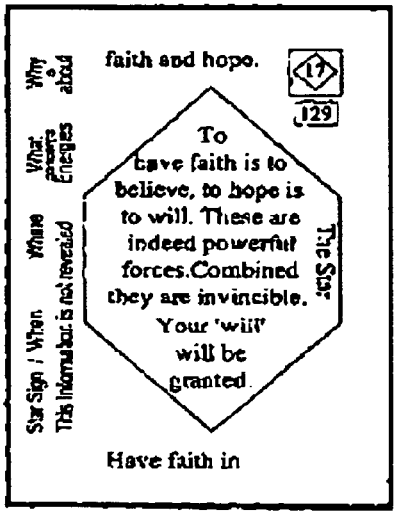
FIG. 4 shows an intermediate card.
Figure 5:
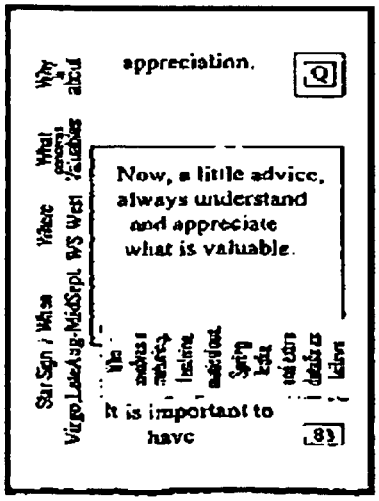
FIG. 5 shows a further intermediate card.
Figure 6:
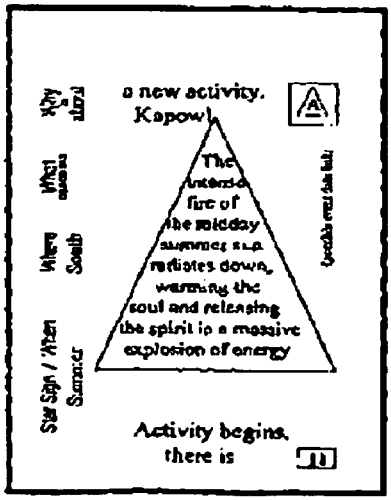
FIG. 6 shows a still further intermediate card.

FIGS. 2 to 5 show sample Story cards from the pack and those of FIGS. 2 and 3 show Story cards which have and 'END' at the lower edge thereof, and the cards of FIGS. 4 to 6 can be considered intermediate cards.

Whilst we have used the word 'END' to, as described later, indicate that the particular layout of cards is completed, it is to be understood that the word 'END' can be replaced by any other appropriate word or by any desired symbol to indicate that no more cards should be dealt.

At the lower edge of all of the cards of FIGS. 1 to 6, there is a first part of a sentence.

Each of the Story cards has the completion of a sentence at its upper edge and, on its lower edge, in the case of the cards of FIGS. 4 to 6, the commencement of a further sentence or, in the case of FIGS. 2 and 3, the word "END".

Between the lower part of the sentence and the upper part of the sentence or 'END', each Story card has a sentence or statement which has some relationship with the second part of the sentence thereabove and, if there is a first part of a sentence therebeneath, this may also be arranged to have some association with the statement.

Considering the Court cards, the statement on the King cards tends to be strongly directive taking his position into account.

The statement on the Queen cards tends to be more trivial and can include transmitting information and gossip.

The Knight moves in and out of ones life so the statement would reflect this.

The Page tends to make announcements which would have been directed by an outside party.

These cards, as mentioned above, may be deemed similar to the major arcana cards of Tarot and the subjects of conversation have an association with the names of the equivalent Tarot cards although this is not necessary.

Adjacent their lower edges, the Subject cards have the commencement of a statement which can have relevance to the basic heading of the card.

For example, the "Moon" card could include the wording:

"An increase in power and strength"

"As the moon's cycle waxes so the effect energises"

"This increase in energy is a good time for."

When the pack is being laid out, the cards, other than the Subject cards, have, as indicated before, different material on each side.

When the game is to be played, the reader shuffles the pack and, during shuffling, can also turn over groups of cards, about their longitudinal or transverse axis so that the final pack does not only have the cards effectively randomly oriented but there is also a random orientation of the front or the backs of the cards.

Also, the Court cards, as illustrated in FIG. 5 may have additional material at right angles to the remainder of the material.

After shuffling, the cards are thus in a random order in themselves and are a random mixture of the fronts and the backs of the cards.

As not all cards are to be dealt on any particular spread, the laying of the cards on the table, then there can be a very substantial variety of combinations of cards as will be understood further herein.

In playing the game the player determines the topics of the game by selecting one or a number of the provided Subject cards and these are set out on the surface on which the game is to be played. The cards are normally laid horizontally on the surface but this is not limiting.

The Story cards, after shuffling are then placed under the Subject cards with the first card being placed under the first Subject card. Story cards continue to be placed until a card bearing 'END' on its lower surface is placed.

The lower edge of the selected Subject card could read 'This reading is about' and if the drawn Story card placed beneath the Subject card is the 'Moon' of the Major Arcana, its upper edge reads 'increasing power and strength', thus the part sentences would combine to read 'This reading is about increasing power and strength'

The lower edge of the 'Moon' card reads 'The rising power of' and if the following Story card was Major Arcana Story card 'Lovers', its upper edge reads 'making a choice'

This, when the two edges are read together the sentence reads 'The rising power of making a choice'

The lower edge of the 'Lovers' card is 'Make the choice, base it on'

If the next drawn card was Minor Arcana Story card 6 Air, its' upper edge reads memories'. As the lower edge of this card states "END', then this terminates the line of comment.

The reading of this line of cards would therefore say, "This reading is about increasing power and strength. The rising power of making a choice. Make the choice, base it on memories".

Each of the Story cards usually has an independent comment placed on the middle thereof, which comment can add an additional dimension of comment to the reading.

The reader then moves to the next subject card and places a card therebeneath.

If this card does not have an "END" on its lower surface, then a further card is placed below this until the card has an "END" written thereon.

Figure 7:
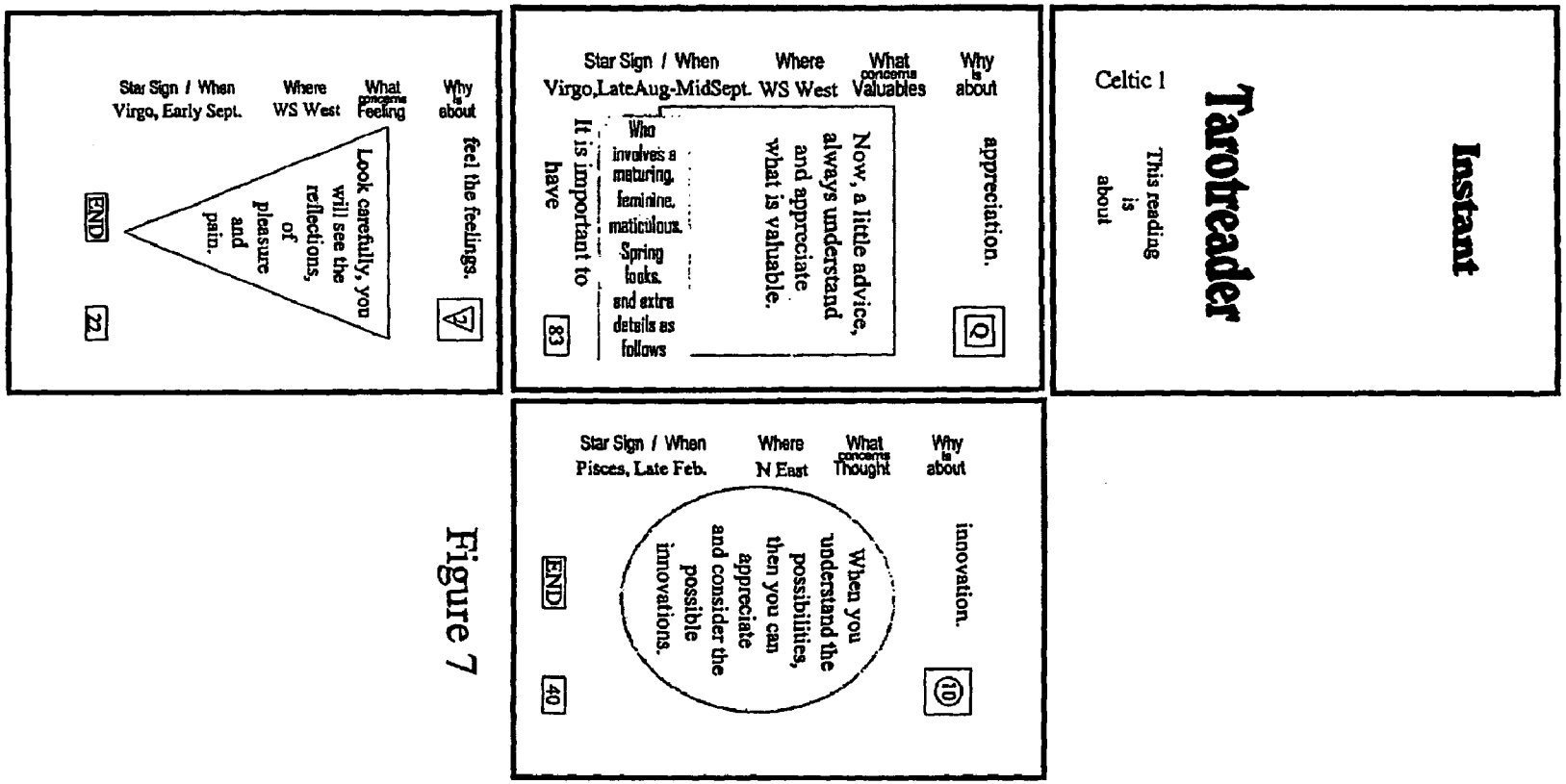
FIG. 7 shows a first spread as dealt.
Figure 8:
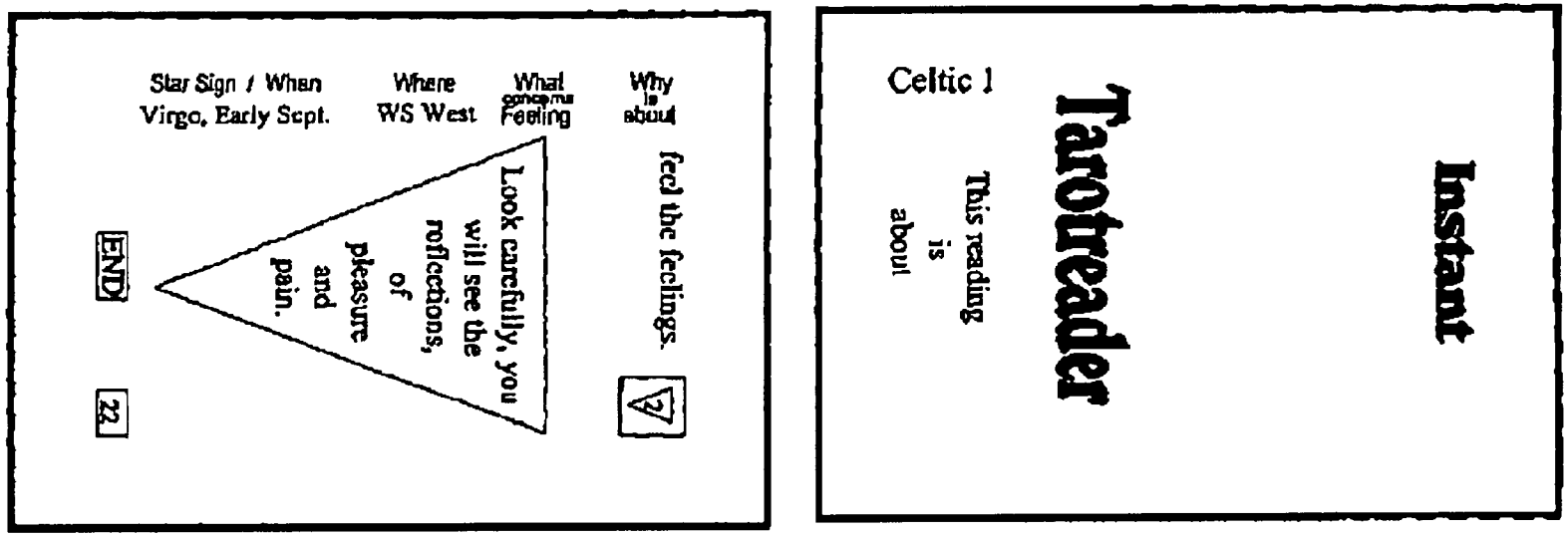
FIG. 8 shows a second spread.

This means that there may be a single card, as shown in FIG. 8, or multiple cards, as shown in FIG. 7, beneath the subject card.

Once the word "END" is reached, the reader then goes to the next subject card and places cards beneath that in the same manner and continues until all of the Subject cards have cards extending downwardly therefrom and the last card in each column has an "END" at its lower edge.

If there are to be side cards on any column, these can either be placed in position after the 'END' card has been located or, if required, the columns can be completed and the side cards positioned.

There are at least two ways in which to read the cards once they have been spread.

The first of these is to simply read the sentences made up from the bottom line of the subject card and the first line of the adjacent Story card therebeneath and, if that card does not have an "END", the sentence commencing at the bottom of the first Story card finishing on the second Story card and so on.

This can provide one, two, three or even more sentences, the commencement of the first of which has an association with the subject heading which, in most cases, will enable the reader to come to an indication from the sentences of something to do with the particular subject heading.

As mentioned above, the sentences may be somewhat ambiguous but, for persons with imagination, a meaning can normally be garnered.

After the sentence(s) have been considered, the person playing the game can then read the material in the center of the or each story card and use this material to embellish the meaning already discussed in relation to the made up sentences.

The alternative is that the first constructed sentences can be read followed by the material in the center of the card and followed again by the next constructed sentence, if there is one, the material in the center of the next card and so on.

In this way the person playing the game can produce a flowing construction of imagined events in respect of the particular subject.

The game can be expanded beyond this. Some of the Court cards, as illustrated in FIG. 5, are provided with material which lies across the card and, wherever this material is located, an additional card can be placed beside that card and the information on it read in association with the material. This arrangement is illustrated in FIG. 7.

The material which lies across the card shows 'who' which indicates the characteristics of a person, alluding to character traits and appearance. When the additional card is placed beside it, it continues the statements to indicate related star sign, zodiac date, where, what and why.

All the game cards illustrated show the where, when, what and why and the star sign.

The "where" indicates the direction that the person or event in discussion goes from or goes to.

The "when" give a time scale.

The "what" refers to elements or things of value, activities and actions, physical and mental feelings, thoughts and ideas or hidden energies?

The "why" a brief indication of reason.

Court cards also show "who".

The star sign will be associated with the "when" as, of course, the zodiac is in what are, effectively, monthly periods which overlap the months.

It is stressed that such additional material is not relevant to the main game but is purely an additional feature to it.

Whilst we have described the invention in relation to a card game using conventional cards, it will be appreciated that variations can be made in this.

Cards or their representation may be similar or may vary. The variations might be assortments of shapes, or size, or number, or number of edges or surfaces. They may link in singular or multiple directions. They may have removable surfaces such as 'scratchy' type cards. For example, we could make cards which are hexagonal or octagonal in shape and the Subject cards could have a number of part sentences around their periphery, the one to be used depending upon the orientation of the card when it is used, and the other cards could have the same, or different, shapes and again could have the completions of the half sentences on more than one face, and the "END" notification or the commencement of another sentence on an opposite face with their being some means to indicate the face which is to be used, possibly derived from the orientation in the pack as it is shuffled.

Also the game is particularly applicable to be applied by computer as a software program which could be provided in different media or on the Internet.

In this case, it would still be desirable to use an equivalent to cards even though, physically, a card may not be shown on the computer but the subjects would be selected from a list set across a screen and then by, say, operating a mouse on a subject. What is effectively a first card is located therebelow and this either indicates that it is the final card in the series or not and further operations can effectively form a spread identical to that described hereinbefore.

The primary idea of the game is that it comprises two or more component parts of information (or ideas or meanings or sentences, or parts of ideas or sentences, each on separate surfaces or media or medium) which are placed (or linked or merged) together to form a more complete or new information (or idea or meaning or sentence). These two parts we I refer to as the Subject and Story cards. These may occur separately as originating Subject cards and Story cards or as combined Subject and Story cards.

What is claimed is:

1. A method of playing a card game, comprising the steps of:

(a) providing a deck of cards, said cards comprising printed material thereon located at the top and bottom edge of said cards said printed material of each of said cards includes a commencement portion of a sentence printed thereon adjacent the bottom edge of said cards and a completion portion of a sentence printed thereon adjacent the top edge of said cards;

(b) shuffling said deck of cards;

(c) selecting at least one card;

(d) placing said selected card on a flat surface with said printed material facing up;

(e) selecting at least one additional card;

(f) placing said selected additional card below said previously selected card with said commencement portion of said previously selected card adjacent said completion portion of said selected card from step (e), thereby producing a path of selected cards;

(g) repeating said steps (e) and (f) until said commencement portion of said selected card of step (e) instructs the user to end the game; and (h) reading said path of selected cards beginning with said commencement portion of said bottom edge of said selected card of said step (c) along with said completion portion of said top edge of said adjacent selected additional card of step (e), then continuing to read said commencement portion of said bottom edge of said additional card along with said completion portion at said top edge of each adjacent said selected cards of said steps (e) and (f) until said selected card instructs the user to end the game.

2. The method of playing a card game as set forth in claim 1, wherein at least one of said cards of said deck further comprising an auxiliary information portion printed thereon located between said completion portion and said commencement portion and oriented at a right angle to said commencement portion and said completion portion, wherein said commencement portion of at least one of said cards is a game ending information.

3. The method of playing a card game as set forth in claim 2 further comprising the step of determining if any of said cards have said auxiliary information portion, and providing an option, if said selected cards contain said auxiliary information portion, of either continuing said path of selected cards of said steps (e) and (f), or producing an additional path of selected cards by repeating said steps (e) and (f) and placing said selected cards adjacent said auxiliary information portion of said previously selected card containing said auxiliary information portion, after said step (g).

4. The method of playing a card game as set forth in claim 3, wherein said step of placing said selected cards adjacent said auxiliary information portion of said previously selected card containing said auxiliary information portion is to place said selected card to the right of said selected card containing said auxiliary information portion.

5. The method of playing a card game as set forth in claim 4, wherein said at least one of said card in said deck of cards further comprising an independent comment information printed thereon located between said completion portion and said commencement portion and adjacent said auxiliary information portion.

6. The method of playing a card game as set forth in claim 5 further comprising the step of reading said independent comment information portion after said step (h).

7. The method of playing a card game as set forth in claim 6 further comprising the step of reading any said additional paths of selected cards formed from said card with said auxiliary information potion beginning with said commencement portion of said card with said auxiliary information portion along with said completion portion of said adjacent selected card, then continuing to read said commencement portion of said adjacent selected card is said path along with said completion portion of any said adjacent additionally selected cards until said card instructs the user to end the game.

8. A method of playing a card game, comprising the steps of:

(a) providing a deck of cards, each of said cards comprising a commencement portion of a sentence printed thereon adjacent the bottom edge of said cards and a completion portion of a sentence printed thereon adjacent the top edge of said cards, wherein at least one of said cards having an auxiliary information portion printed thereon located between said completion portion and said commencement portion, wherein said commencement portion of at least one of said cards is a game ending information;

(b) shuffling said deck of cards;

(c) laying said deck of cards out randomly;

(d) selecting at least one card;

(e) placing said selected card on a flat surface with said printed information facing up;

(f) selecting at least one additional card;

(g) placing said selected additional card below said previously selected card with said completion portion of said previously selected card adjacent said commencement portion of said selected card from step (f), thereby producing a path of selected cards;

(h) repeating said steps (f) and (g) until said commencement portion of said selected card of step (f) is said game ending information;

(i) determining if any of said cards have said auxiliary information portion;

(j) providing an option, if said selected cards contain said auxiliary information portion, of either continuing said path of selected cards of said steps (g) and (h), or producing an additional path of selected cards by repeating said steps (g) and (h) and placing said selected cards adjacent said auxiliary information portion of said previously selected card containing said auxiliary information portion; and (k) reading said path of selected cards beginning with said commencement portion of said selected card of said step (d) along with said completion portion of said adjacent selected card, then continuing to read said commencement portion of said selected cards of said steps (f) along with said completion portion of any said adjacent selected cards until said selected card has said game ending information.

9. The method of playing a card game as set forth in claim 8, wherein said auxiliary information portion of said cards being oriented at a right angle to said commencement portion and said completion portion.

10. The method of playing a card game as set forth in claim 9, wherein said step of placing said selected cards adjacent said auxiliary information portion of said previously selected card containing said auxiliary information portion in said step (j) is to place said selected card to the right of said selected card containing said auxiliary information portion.

11. The method of playing a card game as set forth in claim 8, wherein said deck of cards further comprising an independent comment information printed thereon located between said completion portion and said commencement portion.

12. The method of playing a card game as set forth in claim 11 further comprising the step of reading said independent comment information portion after said step (k).

13. The method of playing a card game as set forth in claim 8, wherein said game ending information is the word "End".

14. A method of playing a card game comprising the steps of:

(a) providing a deck of cards comprising a set of Subject cards, and a set of Story cards, said Subject cards including a commencement portion of a sentence printed thereon adjacent the bottom edge of said Subject card, and a subject information printed thereon adjacent the right edge of said Subject card and oriented at a right angle to said commencement portion, said Story cards further comprising a set of Intermediate cards and a set of End cards, wherein said Intermediate cards including a completion portion of a sentence printed thereon adjacent the top edge of said Intermediate card, a card suite symbol printed thereon adjacent the top right corner of said Intermediate card, a commencement portion of a sentence printed thereon adjacent the bottom edge of said Intermediate card, an independent comment information printed thereon located between said completion portion and said commencement portion, and an additional suite information printed thereon located within said card suite symbol, wherein a plurality of said Intermediate cards further comprising an auxiliary information portion relating to the characteristics of a person, alluding to character traits and appearance, said auxiliary information portion being oriented at a right angle to said independent comment information and located between said commencement portion and said independent comment information, wherein said End cards including a completion portion of a sentence printed thereon adjacent the top edge of said card, a card suite symbol printed thereon adjacent the top right corner of said card, a game ending information printed thereon adjacent the bottom edge of said card, an independent comment information printed thereon located between said completion portion and said ending information, an additional suite information printed thereon located within said card suite symbol;

(b) shuffling said deck of cards;

(c) laying said deck of cards out randomly;

(d) selecting at least one Subject card;

(e) placing said selected Subject card on a flat surface with said printed information facing up and determining the topic of the game by reading said subject information on said Subject card;

(f) selecting at least one Story card;

(g) placing said selected Story card below said selected Subject card with said completion portion of said selected Story card adjacent said commencement portion of said selected Subject card, thereby producing a path of selected cards;

(h) determining if said selected Story card is an Intermediate card, or an End card, whereby if said selected Story card is an End card then said game is ended;

(i) selecting another Story card if said previously selected Story card is an Intermediate card;

(j) determining if said Intermediate card is an Intermediate card with said auxiliary information portion;

(k) placing said newly selected Story card next to said previously selected Intermediate card with said completion portion of said newly selected Story card adjacent said commencement portion of said previously selected Intermediate card, thereby continuing said path of selected cards;

(l) providing an option, if said previously selected Intermediate card contains said auxiliary information portion, of either continuing said path of selected cards by placing said newly selected Story card next to said previously selected Intermediate card with said completion portion of said newly selected Story card adjacent said commencement portion of said previously selected Intermediate card if said previously selected Intermediate card does not have an auxiliary information portion, or producing an additional path of selected cards by placing said newly selected Story card adjacent said auxiliary information portion and at a right angle to said independent comment information of said previously selected Intermediate card if said previously Intermediate card has said auxiliary information portion;

(m) repeating said steps (h), (i), (j), (k), and (l) until said selected Story card is an End card;

(n) reading said path of selected cards beginning with said commencement portion of said Subject card along with said completion portion of said adjacent selected Story card, then continuing to read said commencement portion of said selected Story cards along with said completion portion of any said adjacent additionally selected Story cards until said End card is reached;

(o) reading any said additional paths of selected cards formed from said Intermediate card with said auxiliary information potion beginning with said commencement portion of said Subject card along with said completion portion of said adjacent selected Story card, then continuing to read said commencement portion of said selected Story cards along with said completion portion of any said adjacent additionally selected Story cards until said End card is reached; and (p) reading said independent comment information from said selected Story card.

15. The method of playing a card game as set forth in claim 14 further comprising the step of turning over groups of cards after said step (c), about their longitudinal or transverse axis so that said cards are both effectively randomly oriented and also so the front or the backs of said cards are randomly orientated.

16. The method of playing a card game as set forth in claim 14, wherein said set of Subject cards is made up of eleven Subject cards.

17. The method of playing a card game as set forth in claim 14, wherein said cards of said deck of cards are double-sided.

* * * * *